US005752629A

United States Patent [19]

Hardy

[11] Patent Number: 5,752,629

[45] Date of Patent: May 19, 1998

[54] PASSIVE VENTING FOR PUMP DISPENSING DEVICE

[75] Inventor: Michael E. Hardy, Cincinnati, Ohio

[73] Assignee: The Procter & Gamble Company, Cincinnati, Ohio

[21] Appl. No.: 631,487

[22] Filed: Apr. 12, 1996

[51] Int. Cl.[6] ..... B67D 5/58

[52] U.S. Cl. ..... 222/189.09; 222/383.1; 222/481.5

[58] Field of Search ..... 222/189.09, 383.1, 222/382, 481.5

[56] References Cited

U.S. PATENT DOCUMENTS

| | | | |
|---|---|---|---|
| 3,059,800 | 10/1962 | Mills | 215/56 |
| 3,071,276 | 1/1963 | Pellett et al. | 215/56 |
| 3,100,577 | 8/1963 | Miller, Jr. et al. | 215/56 |
| 3,147,876 | 9/1964 | Lepore | 215/56 |
| 3,263,850 | 8/1966 | Scott | 215/56 |
| 3,315,831 | 4/1967 | Scott | 215/56 |
| 3,315,832 | 4/1967 | Scott | 215/56 |
| 3,409,160 | 11/1968 | Scott | 215/56 |
| 3,448,882 | 6/1969 | Roy | 215/56 |
| 3,471,051 | 10/1969 | Cistone | 215/40 |
| 3,521,784 | 7/1970 | Gaines et al. | 215/56 |
| 3,696,958 | 10/1972 | Lee | 215/56 |
| 3,768,734 | 10/1973 | Anderson, Jr. et al. | 239/333 |
| 3,780,951 | 12/1973 | Powers | 239/333 |
| 3,897,006 | 7/1975 | Tada | 239/333 |
| 3,951,293 | 4/1976 | Schulz | 215/261 |
| 4,136,796 | 1/1979 | Dubois et al. | 220/256 |
| 4,153,203 | 5/1979 | Tada | 239/333 |
| 4,168,788 | 9/1979 | Quinn | 222/383 |
| 4,230,277 | 10/1980 | Tada | 239/333 |
| 4,249,681 | 2/1981 | French | 222/380 |
| 4,519,527 | 5/1985 | Kláeger | 222/383 |
| 4,648,519 | 3/1987 | Kennedy | 215/261 |
| 4,765,499 | 8/1988 | von Reis et al. | 215/261 |
| 4,815,663 | 3/1989 | Tada | 239/333 |
| 4,819,835 | 4/1989 | Tasaki | 222/383 |
| 4,863,051 | 9/1989 | Eibner et al. | 215/261 |
| 4,958,754 | 9/1990 | Dennis | 222/383 |
| 5,074,440 | 12/1991 | Clements et al. | 222/189 |
| 5,082,150 | 1/1992 | Steiner et al. | 222/189 |
| 5,158,233 | 10/1992 | Foster et al. | 239/333 |
| 5,222,637 | 6/1993 | Giuffredi | 222/336 |
| 5,228,602 | 7/1993 | Maas et al. | 222/340 |
| 5,294,025 | 3/1994 | Foster | 222/383 |

(List continued on next page.)

FOREIGN PATENT DOCUMENTS

| | | | |
|---|---|---|---|
| A-41259/93 | 6/1993 | Australia . | |
| 9341259-A | 12/1993 | Australia . | |
| 2162247 | 11/1994 | Canada . | |
| 0 363 172 A2 | 4/1990 | European Pat. Off. | B05B 11/04 |
| 0 593 840 A1 | 4/1994 | European Pat. Off. . | |
| 0706954 A1 | 4/1996 | European Pat. Off. . | |
| 2509-258 | 3/1975 | Germany . | |
| 816564 | 7/1959 | United Kingdom | 222/383.1 |
| 1 464 344 | 2/1977 | United Kingdom . | |
| WO 94/26614 | 11/1994 | WIPO . | |
| WO 95/00195 | 1/1995 | WIPO | A61M 11/00 |
| WO 96/11857 | 4/1996 | WIPO . | |

*Primary Examiner*—Philippe Derakshani
*Attorney, Agent, or Firm*—Rodney M. Young

[57] ABSTRACT

A manually operated pump dispensing device is provided for dispensing a liquid product. The manually operated pump dispensing device includes a container for storing the liquid product, a dispensing pump and a gas-permeable/liquid-impermeable vent. The container has an interior chamber and an exterior that is exposed to the environment. The dispensing pump is attached to the container in fluid communication with the liquid product. The dispensing pump has a discharge orifice and an actuator. The gas-permeable/liquid-impermeable vent comprises a venting module that includes a membrane and a support frame. The membrane is gas-permeable/liquid-impermeable and is affixed onto the support frame such that the membrane surrounds the support frame. The vent allows for communication between the interior chamber and the environment, thereby passively venting the container.

13 Claims, 3 Drawing Sheets

Fig. 1

U.S. PATENT DOCUMENTS

| | | | |
|---|---|---|---|
| 5,299,717 | 4/1994 | Geier | 222/340 |
| 5,303,867 | 4/1994 | Peterson | 239/333 |
| 5,337,928 | 8/1994 | Foster et al. | 222/383 |
| 5,341,967 | 8/1994 | Silvenis | 222/376 |
| 5,344,053 | 9/1994 | Foster et al. | 222/383 |
| 5,373,972 | 12/1994 | Bystrom et al. | 222/212 |
| 5,407,087 | 4/1995 | Giblin et al. | 215/260 |
| 5,425,482 | 6/1995 | Foster et al. | 222/207 |
| 5,431,310 | 7/1995 | Kanner et al. | 222/212 |
| 5,462,209 | 10/1995 | Foster et al. | 222/376 |
| 5,467,900 | 11/1995 | Maas et al. | 222/341 |
| 5,472,119 | 12/1995 | Park et al. | 222/145.8 |
| 5,472,122 | 12/1995 | Appleby | 222/212 |
| 5,476,195 | 12/1995 | Oder et al. | 222/207 |
| 5,579,936 | 12/1996 | Costa et al. | 215/261 |

PASSIVE VENTING FOR PUMP DISPENSING DEVICE

FIELD OF THE INVENTION

The present invention relates to pump dispensing devices for use with consumer product containers; and more particularly, to such devices which allow venting of gases without allowing leakage of the liquid product.

BACKGROUND OF THE INVENTION

Manually operated dispensing devices for pumping a liquid from a supply container are widely known in the art. Typically manually operated pump dispensing devices are provided with at least one vent from the interior chamber of the container to the exterior environment in order to allow air to enter the container as liquid is drawn from the container through the dispensing device in order to prevent either collapse of the container from the vacuum created therein or a cessation of the liquid flow, both of which are undesirable. One problem associated with most manually operated pump dispensing devices is keeping the liquid from leaking out of the associated container through the vent during periods of use when the container is inverted or as the liquid product is splashed around within the container, or even during periods when the user might wish to lay the container down or to carry it from one job to another, or even during shipment.

Additionally, certain liquid products, for example, hydrogen peroxide or other bleaches as well as carbonated beverages or other liquids which cause chemical reactions, can generate gases and this can lead to the build up of pressure inside the interior chamber of the container. Without a way to vent these gases the container is subjected to severe stress which usually causes bulging or stress cracking of the container. Bulging refers to the deformation of the container, while stress cracking may cause leakage, bursting, or in extreme circumstances an explosion which can create a potentially hazardous or detrimental situation. These problems are less apparent in thick-walled containers but consideration of cost and the desire to minimize usage of material resources, thereby reducing the environmental impact, tends to favor use of thin-walled containers where possible. Containers for most consumer products which include manually operated pump dispensing devices are typically thin-walled and are often made of plastic. Thus to avoid these potential problems it would be desirable to vent the container on which the manually operated pump dispensing device is attached during periods of use as well as non-use.

Various venting mechanisms have attempted to solve one aspect of this problem or another. Many of these devices are complex, difficult to make and expensive, while still falling short of resolving all of the above mentioned concerns. Most manually operated pump dispensing devices provide venting mechanisms that require manual operation or some other form of user interaction. Typically such venting mechanisms have an open position allowing the passage of fluids and a closed position in which the vent is entirely closed off preventing the passage of any fluids. In this type of venting mechanism the problem of off-gassing is exacerbated when the vent is closed. Some other manually operated pump dispensing devices provide only one-way venting, for example, when the pressure within the container is less than the pressure of the exterior environment, air is permitted to enter the container. Still other venting mechanisms are simply open passages through which air enters or exits the container. However, this latter type of venting mechanism also allows the liquid product to leak out of the container when the container is agitated or inverted.

Consequently, the need exists for a manually operated pump dispensing device that allows gases to enter and exit the container housing the liquid product, while also preventing the liquid product from leaking from the container during periods of use and non-use without the use of complex valve systems that are expensive to manufacture. It would also be beneficial to provide such a manually operated pump dispensing device that vents passively so as not to require any user interaction.

SUMMARY OF THE INVENTION

In one embodiment of the invention, a manually operated pump dispensing device for dispensing a liquid product is provided. The manually operated pump dispensing device comprises a container for storing the liquid product. The container has an interior chamber and an exterior exposed to the environment. A dispensing pump is attached to the container in fluid communication with the liquid product. The dispensing pump has a discharge orifice and an actuator. Preferably, the dispensing pump further comprises a housing having a reciprocating piston therein and the reciprocating piston being moveable between a non-dispensing position and a dispensing position. Alternatively, the dispensing pump can comprise a flexible pump. The actuator preferably comprises a trigger being attached to the housing and connected to the dispensing pump in order to actuate the dispensing pump when an operating force is applied to the actuator. The housing has a closure for sealingly attaching the housing and the dispensing pump to the container. The housing includes an inlet passageway providing fluid communication between the liquid product within the interior chamber and the dispensing pump and an outlet passageway providing fluid communication between the dispensing pump and the discharge orifice. The housing preferably has a vent aperture therethrough allowing communication between the interior chamber and the environment. A gas-permeable/liquid-impermeable vent is also provided. The gas-permeable/liquid-impermeable vent further comprises a venting module having a membrane and a support frame. The support frame having open spaces formed therein. The membrane is substantially gas-permeable/liquid-impermeable. The membrane preferably comprises an acrylic copolymer which more preferably has a hydrophobic coating of a fluoro-monomer which is polymerized onto the membrane using UV light. The membrane includes pores having a diameter in the range of from about 0.005 microns to about 10 microns. The support frame preferably comprises a non-woven nylon or a polyethylene terephthalate. The membrane is affixed onto the support frame such that the membrane spans the open spaces in the support frame. The membrane is preferably cast onto the support frame. The venting module is preferably attached by the support frame to the housing, over the vent aperture. The venting module being substantially impermeable to liquids while allowing the passage of gases through the membrane into and out of the interior chamber thereby passively venting the container.

In a second embodiment of the present invention, the gas-permeable/liquid-impermeable vent is integrally formed with the housing.

BRIEF DESCRIPTION OF THE DRAWINGS

While the specification concludes with claims particularly pointing out and distinctively claiming the present invention, it is believed that the present invention will be better understood from the following description in conjunction with the accompanying drawings in which like reference numerals identify identical elements and wherein;

DETAILED DESCRIPTION OF THE INVENTION

Figure 1:
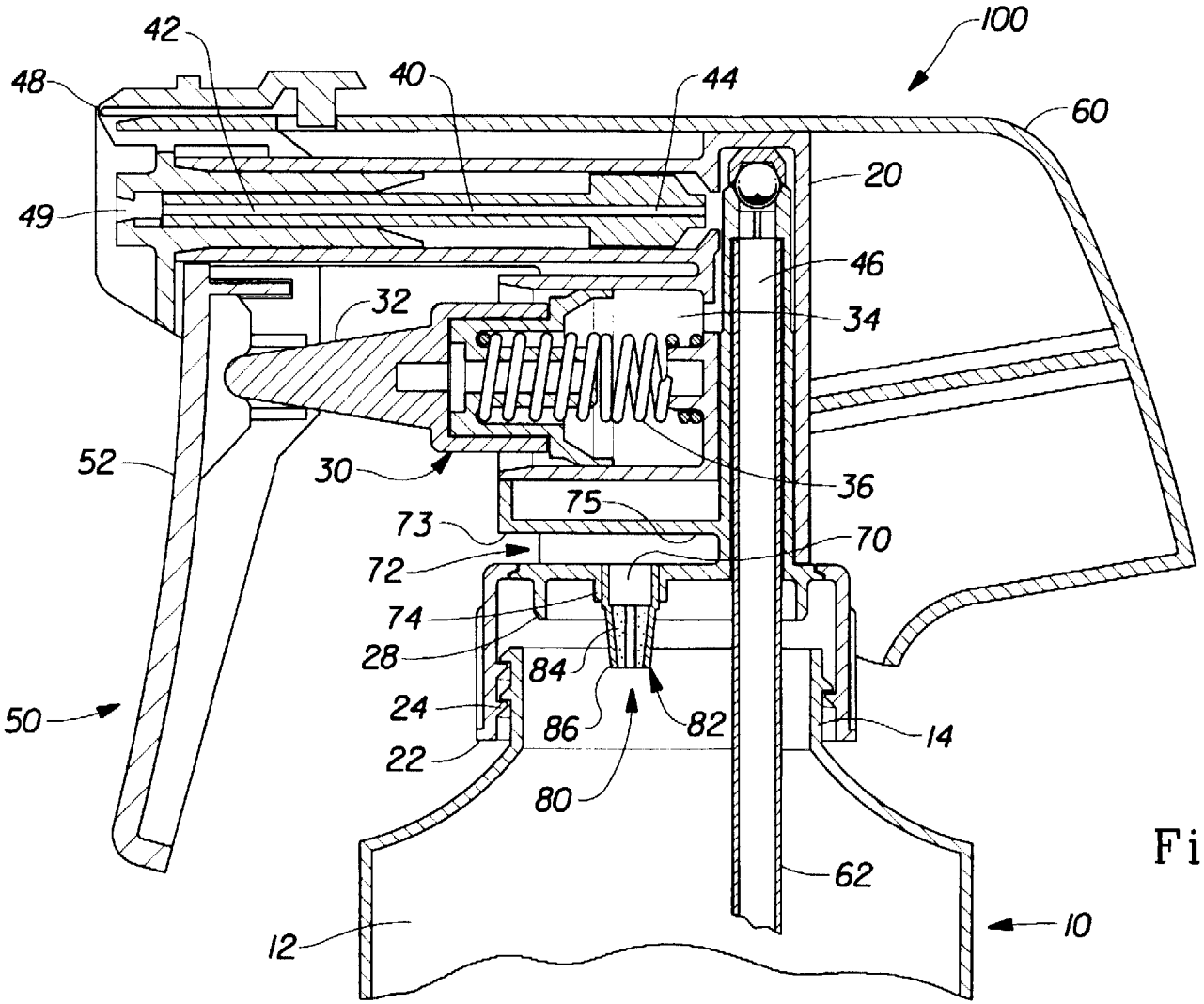
FIG. 1 is a vertical, cross-sectional view of the manually operated pump dispensing device of the present invention.

Referring now to the drawings, in FIG. 1 there is shown in a cross-sectional view a particularly preferred embodiment of a manually operated pump dispensing device, designated generally as 100, of the present invention. Referring to FIG. 1, the manually operated pump dispensing device 100 is provided with a housing 20 that is adapted to be sealingly attached to a liquid supply container 10. The housing 20 is used for mounting a dispensing pump 30 so that the dispensing pump 30 is in fluid communication with the container 10.

The housing 20 can preferably be enclosed in a shroud 60. Typically the shroud 60 is used to encase the housing 20 and provide a more aesthetically pleasing package for the consumer. The housing 20 includes an outwardly extending discharge passageway 40 having a distal end 42 and a proximate end 44. The discharge passageway 40 is preferably formed integral to the housing 20. The discharge passageway 40 is in fluid communication with the dispensing pump 30. The housing 20 further includes an inlet passageway 46 that extends downwardly from the dispensing pump 30. A nozzle portion 48 is attached in fluid communication to the distal end 42 of the discharge passageway 40. The nozzle portion 48 includes a discharge orifice 49. The nozzle portion 48 can preferably be molded from a thermoplastic material such as polypropylene, polyethylene, or the like.

An actuator 50 preferably in the form of an actuation lever or trigger 52 is pivotally attached to the housing 20 and connected to the dispensing pump 30. Inside the housing 20 the dispensing pump 30 is manually operated by actuation of the trigger 52 in a manner conventional to such dispensing pumps that are adapted to be actuated by a trigger 52. The dispensing pump 30 preferably has a reciprocating piston 32 therein that slides in sealing relation to a pump chamber 34 when actuated and includes a spring member 36 that biases the reciprocating piston 32 and trigger 52 to a non-dispensing position. A more detailed description of the features and components of such a conventional dispensing pump 30 can be found in, for example, U.S. Pat. No. 4,958,754 issued Sep. 25, 1990 to Stephen R. Dennis, which is hereby incorporated herein by reference. Conventional dispensing pumps of this general type are, for example, commercially available versions sold by Continental Sprayers, Inc. under the trade name "T8500".

The container 10 must be suitable for storing liquid products. Preferably, the container 10 and the housing 20 are impervious to fluids. Such a container 10 comprises an interior chamber 12 and a hollow neck finish 14. The neck finish 14 is preferably located at the upper most portion of the container 10 and is used to sealingly attach the container 10 to the housing 20 and provides access to the interior chamber 12. The container 10 can be constructed of various materials that are well known in the art, such as metals, glass, and the like. Preferably the container 10 is constructed of a plastic material, for example, polyethylene, polyvinyl chloride, polyethylene terephthalate, polyester, polypropylene, polycarbonate, nylon, or the like. Typically such a container 10 is formed by blow molding but such container 10 can be formed in various shapes and sizes by various methods well known in the art.

On the housing 20, located opposite the discharge passageway 40, there is a closure 22. Preferably, the closure 22 has threads 24 therein and is made to mate with threads on the neck finish 14 of the container 10. In this manner the housing 20 is threaded onto the container 10 and the dispensing pump 30 is placed in fluid communication with the interior chamber 12 through the inlet passageway 46. The inlet passageway 46 can be adapted to connect to a hollow dip tube 62 which places the inlet passageway 46 in fluid communication with the liquid product stored within the interior chamber 12 of the container 10. Alternatively, the closure 22 and neck finish 14 can be constructed in any manner known in the art so as to form a variety of sealingly attached connections between the container 10 and the manually operated pump dispensing device 100, for example, a snap-fit, bayonet-fit, plug-fit, quick disconnect, or the like.

Also included on the housing 20 is a flange 28. The flange 28 extends radially outwardly around the inlet passageway 46. The closure 22 is connected to the housing 20 by the flange 28. Preferably a portion of the flange 28 acts as a seal between the closure 22 and the neck finish 14 of the container 10. The housing 20, including the flange 28 and closure 22, along with the shroud 60 can be fabricated as individual parts or alternatively they can be integrally molded by, for example, injection molding or other methods well known in the art. Additionally, these components can be formed from various materials such as a thermoplastic material, for example, polypropylene, polyethylene, polystyrene, polyester, polyvinyl chloride, polycarbonate, nylon, or the like.

The housing 20 further includes a vent aperture 70 therethrough. The vent aperture 70 extends through the flange 28 thereby allowing communication between the interior chamber 12 and the exterior environment. In this preferred embodiment, as shown in FIG. 1, the housing 20 includes an outwardly opening bore 72 having an outer end 73 and an inner end 75 formed within the housing 20 just below the dispensing pump 30. The outwardly opening bore 72 provides a conduit that leads to the vent aperture 70 positioned at the inner end 75 thereof The vent aperture 70 extends through the housing 20 to permit ambient air from the environment to enter into the interior chamber 12 of the container 10 while also allowing gasses within the interior chamber 12 to escape and flow into the environment. Preferably a cylindrically shaped connecting ring 74 attached to the flange 28 forms the periphery of the vent aperture 70. The connecting ring 74 extends downwardly from the flange 28 to a position within the interior chamber 12 of the container 10 above the liquid product.

Attached to the connecting ring 74 is a means for passively venting the manually operated pump dispensing device 100 and associated container 10 to atmospheric pressure both during periods of use (i.e., during and immediately after a dispensing cycle) and non-use (i.e., static conditions without user interaction). In the present invention, the means for passively venting the manually operated pump dispensing device 100 preferably comprises a gas-permeable/liquid-impermeable vent 80. This gas-permeable/liquid-impermeable vent 80 is preferably in the form of a venting module 82 which allows gasses generated within the interior chamber 12 to exit to atmosphere and avoid over pressurizing the container 10 while also allowing ambient air to enter into the container 10 in order to avoid collapse of the container 10 when the liquid product is dispensed. Additionally, the liquid product stored within the container 10 can not permeate the venting module 82 and thus spillage or leakage of the liquid product is avoided. This venting module 82 therefore provides two-way venting during periods of use as well as non-use and thereby passively vents the container 10.

Figure 2:
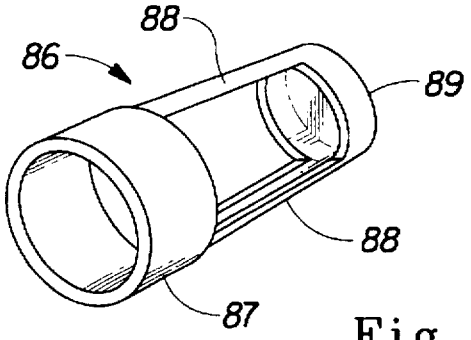
FIG. 2 is a perspective view of the support frame of the present invention.

The venting module 82 comprises a membrane 84 and a support frame 86 having open spaces formed therein. The support frame 86, as seen in FIG. 2, preferably comprises a cylindrical, hollow cap 87 with support arms 88 being spaced away from each other forming open spaces therebetween. The support arms 88 extend between the hollow cap 87 and a closed cylindrical collar 89. This support frame 86 is preferably injection molded of polypropylene, polyethylene terephthalate, polyethylene, nylon, or other polyolefins, or copolymers thereof Preferably the collar 89 has rounded edges in order to avoid damage to the membrane 84 during shipment and handling. Although this is a preferred configuration for the support frame 86, various other configurations can also be utilized.

Figure 3:
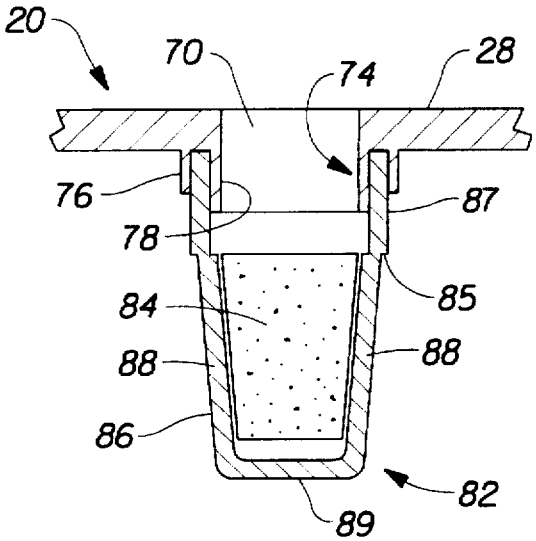
FIG. 3 is a cross-sectional view of the venting module of the present invention.

As best shown in FIG. 3, the cap 87 is preferably sized to provide a frictional fit with the connecting ring 74 thus allowing the support frame 86 to be attached to the housing 20. The connecting ring 74 can preferably comprise a first cylindrical wall 76 concentric to a second cylindrical wall 78 wherein the space between the first and second cylindrical walls 76, 78 is sized to frictionally engage the cap 87 of the venting module 82. A lip 85 which extends inward from the cap 87 to the support arms 88 provides a surface on which a force can be applied in order to engage the frictional fit between the cap 87 and connecting ring 74 thereby attaching the venting module 82 to the flange 28 on the housing 20. Alternatively, the attachment feature between the cap 87 and connecting ring 74 can be formed of various mechanisms known in the art. For example, the attachment feature can be an outwardly protruding rim along the circumference of the connecting ring 74 with a corresponding circumferential groove or recess along the inside of the cap 87 forming a snap fit engagement when the cap 87 is fitted over the connecting ring 74. Furthermore, the cap 87 can be affixed to the connecting ring 74 by use of permanent attachment methods, such as adhesive bonding or even integral molding, or by use of other temporary attachment methods, such as a threaded connection.

The membrane 84 provided herein must be impermeable to liquid flow but permeable to gas flow. Gas permeable as used herein refers to the ability of the membrane 84 to allow gasses to pass through the membrane 84. Preferably, the venting module 82 will have an air flow rate of between about 400 cc and about 650 cc per minute when exposed to an air pressure of about 400 mm of water. As used herein, liquid impermeable refers to the ability of the membrane 84 to resist the passage of liquids therethrough. Preferably, the venting module 82 will not allow a single drop of water (visible to the naked eye) to pass through the membrane 84 when exposed to an increasing water pressure (increased to about 4500 mm of water at about 100 mbar/min.) of up to about 4500 mm of water, and held at about 4500 mm of water for a period of five minutes.

The thickness of the gas-permeable - liquid impermeable membrane 84 can be selected based on the thickness of the associated components it is affixed onto but typically such a membrane 84 is a thin layer, that is preferably having a thickness in the range of about 0.01 mm to about 2 mm, and most preferably from about 0.05 mm to about 0.5 mm. The membrane 84 can be composed of a synthetic material, for example, a microporous plastic film. The size of the pores through the membrane material are such as to allow passage of air and gasses therethrough while being impermeable to liquids. The membrane 84 can be selected from among various manufacturers having pores with a diameter preferably in the range of from about 0.005 μm to about 10 μm, and more preferably from about 0.01 μm to about 3 μm, and most preferably from about 0.2 μm to about 1 μm. For example, these membranes 84 can preferably be manufactured from an acrylic copolymer using a solvent evaporation process in which the acrylic copolymer is processed to distribute a fine distribution of volatile components within the polymer. More preferably the membrane 84 is manufactured from an acrylic nitrile polymer. These volatiles are then evaporated during curing of the membrane producing the porous membrane structure. Thus, the actual membrane material can be very delicate and is typically not used without the support frame 86.

In order to repel liquids, the membrane 84 is treated with a material to aid in repelling liquid penetration while minimizing the restriction to gas passage. Preferably, this treatment includes a hydrophobic coating being applied to the membrane 84. This hydrophobic coating preferably consists of a fluoro-monomer and more preferably a fluoroacrylate monomer. The membrane 84 is soaked in this fluoro-monomer during production and the entire membrane 84 is UV cured in order to polymerize the fluoro-monomer. This coating is throughout the membrane 84 and is not just on the surface. This preferred membrane 84 is made using a polyester material having a pore size of about 0.8 microns and is commercially available from Gelman Sciences Inc. being manufactured under the trade name Versapor® R Membrane V800TR. The dry air flow through this preferred membrane 84 is preferably from between about 5 liters/min./$cm^2$ to about 15 liters/min./$cm^2$ at a pressure of about 13.5 psi, and more preferably about 10 liters/min./$cm^2$ at a pressure of about 13.5 psi. Additional microporous membrane materials can include, for example, non-woven plastic films such as the non-woven spunbonded polyethylene film material sold under the trade name, Tyvek manufactured by the Du Pont Company. Various other synthetic membranes 84 prepared by sintering, stretching, track-etching, template leaching and phase inversion methods are also useful with the invention described herein.

The venting module 82 of the most preferred embodiment has a length of between about 15 mm to about 17 mm and has a diameter of between about 8 mm to about 9 mm. The cap 87 has an internal diameter of preferably about 6.4 mm to about 6.5 mm and also preferably has a length of about 5 mm to about 6 mm. In this embodiment, the tapered section of the venting module 82 contains membrane pieces 84 that are preferably about 8 mm long and are about 6 mm wide. In this most preferred embodiment, the venting module 82 has two membrane pieces 84 spanning between and affixed to two support arms 88. Although this is a most preferred embodiment for the venting module 82, various other configurations and sizes can also be utilized.

The membrane 84 is affixed onto the support frame 86 preferably in a manner such that the membrane 84 spans the open spaces in the support frame 86. More preferably, the membrane 84 is affixed in a manner that surrounds the support frame 86 or encases the support frame 86. FIG. 3 depicts a view of the membrane 84 affixed to the support frame 86. One method of affixing the membrane 84 onto the support frame 86 is to cast or heat seal the membrane 84 onto preferably a non-woven nylon or polyester fiber sheet type support frame 86. This provides an added degree of mechanical integrity. More preferably the venting module 82 can be manufactured using an insert molding process. The membrane material can be fed into a split mold and when the mold is closed around the membrane 84, the membrane 84 is cut to the correct dimensions and then folded into the mold cavity. The membrane 84 is next clamped into the cavity and a resin is then injected into each cavity. The resin forms a leak tight seal with the membrane material and thus the support frame 86 is affixed to the membrane 84 forming the venting module 82.

Figure 4:
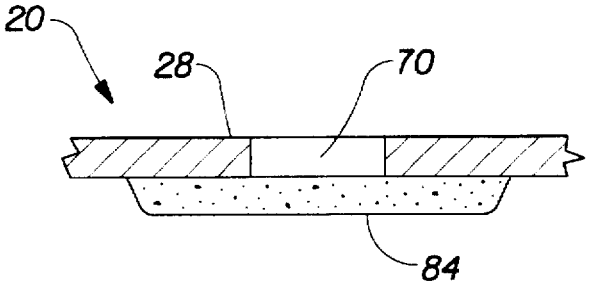
FIG. 4 is a first alternative embodiment showing partial cross-sectional view of the membrane integrally attached over the vent aperture of the housing.

In a first alternative embodiment, the membrane 84 can be formed integral to the flange 28 on the housing 20 of the manually operated pump dispensing device 100. FIG. 4 depicts a partial cross-sectional view of this first alternative embodiment showing the membrane 84 integrally attached over the vent aperture 70 of the housing 20. When the membrane 84 is integrally formed with the housing 20 the support frame 86 and venting module 82 are eliminated since the membrane 84 is simply supported by the flange 28. The same processes previously mentioned can be utilized to create the membrane 84. The membrane 84 can be integrally affixed to the housing 20 over the vent aperture 70 in various leak tight manners well known in the art. For example, the membrane 84 can be molded, heat sealed, ultrasonically welded, or bonded to the housing 20 using an adhesive, glue, or the like.

During operation, the container 10 is filled with a liquid product, such as, for example, carpet cleaners, hard-surface cleaners, household cleaners, dishwashing liquid, liquid detergents, liquid disinfectants, liquid bleaches, peroxide bleach, liquid car care products, liquid shampoos, personal/beauty care liquids, or the like. The manually operated pump dispensing device 100 is attached to the container 10 by a closure 22 with dip tube 62 extending below the liquid product surface. When dispensing or spraying is desired, the trigger 52 is manually moved by the user upon the application of an operating force, thereby causing the dispensing pump 30 to actuate. Actuation of the dispensing pump 30 causes the liquid to flow under pressure through the discharge passageway 40 and into the nozzle portion 48 and then out of the discharge orifice 49. When the trigger 52 is released, the trigger 52 and dispensing pump 30 returns to the non-dispensing position under the urging of a biasing spring force. As the dispensing pump 30 returns to its original non-dispensing position, a negative pressure, or vacuum is created within the pump chamber 34. Ambient air is allowed to enter the container 10 through the venting module 82 and vent aperture 70. The venting module 82 prevents the liquid product from passing through the vent aperture 70 even when the container 10 is agitated or inverted during a dispensing cycle. Simultaneously, liquid product is drawn up into the pump chamber 34 of the dispensing pump 30 through the dip tube 62 thereby preparing the dispensing pump 30 for the next dispensing cycle. Subsequent actuation and release of the trigger 52 repeats the above dispensing cycle and allows the liquid product to be dispensed or sprayed through the discharge orifice 49.

If the liquid is to be dispensed in the form of a spray, the nozzle portion 48 can be of the pressure swirl or impingement variety, or the like. When a pressure swirl nozzle is utilized, the liquid exiting the discharge orifice 49 is in the form of a thin conical sheet which quickly breaks up into fluid particles. When an impingement nozzle is used the liquid is discharged in impinging streams that break up upon impact or interaction with each other. Alternatively, the liquid can be dispensed in the form of a foam, stream, spray or any combination of these forms. Thus, the nozzle portion 48 can comprise various types of nozzles that are well known in the art for dispensing liquids through a discharge orifice 49.

After operation and during periods of non-use, air as well as other gasses can flow through the venting module 82 into and out of the container 10 through the gas-permeable/liquid-impermeable membrane 84. This allows for off-gassing during periods of non-use. Off-gassing typically occurs when gasses are naturally generated by the liquid product housed within the container 10. These gasses are vented to the environment through the venting module 82 as the pressure within the container 10 increases thereby avoiding over stressing or over pressurizing the container 10. Since the venting module 82 allows gasses to pass through without any interaction from the user, this manually operated pump dispensing device 100 acts to passively vent the container 10. Additionally, since the venting module 82 is liquid impermeable, no liquids are allowed to escape to the environment through the venting module 82.

Figure 5:
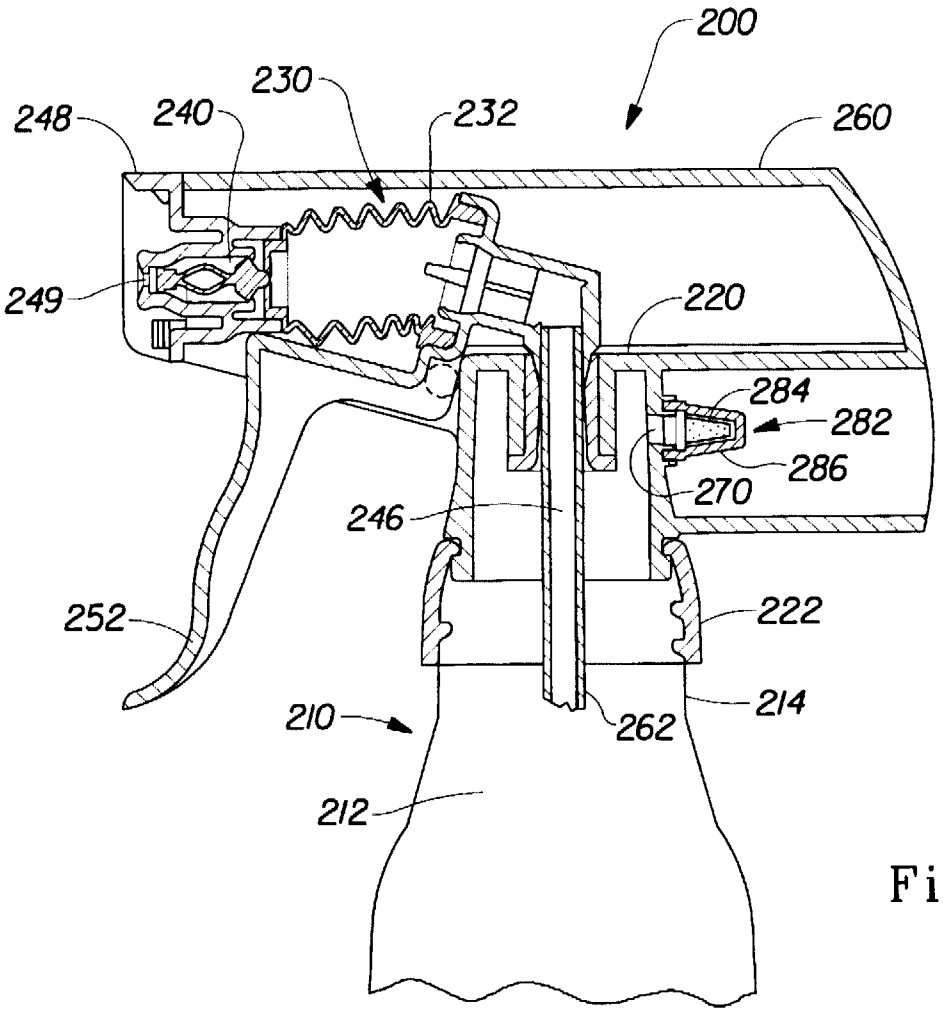
FIG. 5 is a vertical, cross-sectional view of a second alternative embodiment of a manually operated pump dispensing device of the present invention.

Various modifications to the above described manually operated pump dispensing device 100 can be made without departing from the spirit and scope of the claims. For example, as shown in FIG. 5, a second alternative embodiment of the manually operated pump dispensing device 200 includes a housing 220 sealingly attached to a container 210 and a flexible pump 230 mounted within the housing 220. In this embodiment, the dispensing pump 30 of FIG. I is replaced by the flexible pump 230. The flexible pump 230 comprises a resilient structure 232 which permits the flexible pump 230 to be compressed by the trigger 252 wherein the flexible pump 230 returns to its initial non-dispensing position when the trigger 252 is released. The resilient structure 232 can be molded from a resilient thermoplastic such as polypropylene, polyethylene or the like, or from an elastomeric material such as a thermoplastic elastomer, rubber, or the like. This embodiment also includes a discharge passageway 240 having a nozzle portion 248 with a discharge orifice 249 and also includes an inlet passageway 246 extending into the interior chamber 212 of he container 210. The discharge passageway 240 and the inlet passageway 246 are both in fluid communication with the flexible pump 230. Preferably, the trigger 252 is pivotally attached to the housing 220 and also connected to the flexible pump 230. A more detailed description of the features and components of such a flexible pump 230 can be found in, for example, U.S. Pat. No. 5,303,867 issued Apr. 19, 1994 to Robert J. Peterson, which is hereby incorporated module 282 including a gas-permeable/liquid-impermeable membrane 284 is attached over a vent aperture 270, located in an alternative position, in the housing 220. The vent aperture 270 extends through the housing 220, thereby allowing communication between the interior chamber 212 and the environment. Thus, the venting module 282 permits ambient air from the environment to enter into the interior chamber 212 of the container 210 while also allowing gasses within the interior chamber 212 to escape and flow to the environment, thereby passively venting the container 210.

Although particular versions and embodiments of the present invention have been shown and described, various modifications can be made to this manually operated pump dispensing device 100 without departing from the teachings of the present invention. The terms used in describing the invention are used in their descriptive sense and not as terms of limitation, it being intended that all equivalents thereof, be included within the scope of the appended claims.

What is claimed is:

1. A pump dispensing device for dispensing a liquid product comprising:

a cotainer for storing the liquid product, the container having an interior chamber and an exterior exposed to the environment;

a dispensing pump and a housing in which the dispensing pump is mounted, an actuator being attached to the housing and connected to the dispensing pump in order to actuate the dispensing pump when an operating force is applied to the actuator, the housing having a closure for sealingly attaching the housing and the dispensing pump to the container, the housing including an inlet passageway providing fluid communication between the liquid product and the dispensing pump and an outlet passageway providing fluid communication between the dispensing pump and the discharge orifice, the housing further including a vent aperture therethrough, the vent aperture allowing communication between the interior chamber and the environment;

a venting comprising a membrane and support frame, the support frame having open spaces formed therein, the membrane being affixed onto the support frame such that the membrane spans the open spaces in the support frame, the support frame attaching the membrane over vent aperture in the housing, the membrane being substantially impermeable to liquid while allowing the passage of gases through the membrane into and out of the interior chamber thereby passively venting the container.

2. The pump dispensing device according to claim 1 wherein the membrane comprises an acrylic copolymer.

3. The pump dispensing device according to claim 1 wherein the support frame comprises a non-woven nylon.

4. The pump dispensing device according to claim 1 wherein the support frame comprises a polyethylene terephthalate.

5. The pump dispensing device according to claim 1 wherein the membrane includes pores having a diameter in the range of from about 0.005 microns to about 10 microns.

6. The pump dispensing device according to claim 1 wherein the membrane is cast onto the support frame.

7. The pump dispensing device according to claim 1 wherein the membrane includes a hydrophobic coating.

8. The pump dispensing device according to claim 7 wherein the hydrophobic coating comprises a fluoro-monomer.

9. The pump dispensing device according to claim 8 wherein the fluoro-monomer is polymerized onto the membrane using UV light.

10. A pump dispensing device for dispensing a liquid product comprising:

a container for storing the liquid product, the container having an interior chamber and an exterior exposed to the environment;

a dispensing pump and a housing in which the dispensing pump is mounted, an actuator being attached to the housing and connected to the dispensing pump in order to actuate the dispensing pump when an operating force is applied to the actuator, the housing having a closure for sealingly attaching the housing and the dispensing pump to the container, the housing including an inlet passageway providing fluid communication between the liquid product and the dispensing pump and an outlet passageway providing fluid communication between the dispensing pump and the discharge orifice, the housing further including a vent aperture therethrough, the vent aperture allowing communication between the interior chamber and the environment;

a venting module comprising a membrane and a support frame, the support frame having open spaces formed therein and comprises a polyethylene terephthalate, the membrane being affixed onto the support frame such that the membrane surrounds the support frame, the membrane comprises an acrylic copolymer and includes pores having a range of sizes from about 0.005 microns to about 10 microns, the support frame attaching the membrane over the vent aperture in the housing, the membrane being substantially impermeable to liquids while allowing the passage of gases through the membrane into and out of the interior chamber thereby passively venting the container.

11. A pump dispensing device for dispensing a liquid product comprising:

a dispensing pump and a housing in which the dispensing pump is mounted, the dispensing pump having a discharge orifice and an actuator; and a gas-permeable/liquid-impermeable venting module attached to the housing, the venting module includes a membrane and a support frame, the membrane being substantially gas-permeable/liquid-impermeable, the support frame being a hollow cap with support arms, and the membrane being affixed onto the support frame.

12.The pump dispensing device according to claim 11 wherein the membrane has a dry air flow rate that is between about 5 liters/min./$cm^2$ to about 15 liters/min./$cm^2$.

13.The pump dispensing device according to claim 11 wherein the venting module has an air flow rate of between about 400 cc to about 650 cc per minute when exposed to an air pressure of about 400 mm of water.

* * * * *

UNITED STATES PATENT AND TRADEMARK OFFICE

CERTIFICATE OF CORRECTION

PATENT NO. : 5,752,629

DATED : May 19, 1998

INVENTOR(S) : Michael E. Hardy

It is certified that error appears in the above-identified patent and that said Letters Patent is hereby corrected as shown below:

Column 9, line 29, after "venting" insert -- module --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*